United States Patent [19]

Bexton

[11] Patent Number: 4,788,730

[45] Date of Patent: Dec. 6, 1988

[54] GEL-FILLED, VARIABLY-ADJUSTABLE CUSHIONING SYSTEM FOR SUPPORTING A PERSON

[76] Inventor: Robert A. Bexton, 3030 Saratoga St., Bakersfield, Calif. 93306

[21] Appl. No.: 127,776

[22] Filed: Dec. 2, 1987

[51] Int. Cl.[4] ..... A47C 27/10

[52] U.S. Cl. ..... 5/454; 5/451; 5/455

[58] Field of Search ..... 5/454, 453, 455, 449, 5/450, 451

[56] References Cited

U.S. PATENT DOCUMENTS

| | | | |
|---|---|---|---|
| 2,372,218 | 3/1945 | Manson et al. | 5/454 |
| 2,700,165 | 1/1955 | Talisman | 5/453 |
| 3,583,008 | 6/1971 | Edwards | 5/454 |
| 4,067,078 | 1/1978 | Winston | 5/455 |
| 4,163,297 | 8/1979 | Neumark | 5/455 |
| 4,306,322 | 12/1981 | Young et al. | 5/454 |
| 4,454,615 | 6/1984 | Whitney | 5/449 |
| 4,621,383 | 4/1986 | Gendala | 5/454 |
| 4,628,557 | 12/1986 | Murphy | 5/465 |

FOREIGN PATENT DOCUMENTS

| | | | |
|---|---|---|---|
| 1302522 | 1/1973 | United Kingdom | 5/449 |
| 1463672 | 2/1977 | United Kingdom | 5/450 |

OTHER PUBLICATIONS

Richard A. Berjian et al "Skin Pressure Measurements on Various Mattress Surfaces in Cancer Patients" 62 American Journal of Physical Medicine 217 (1983).

*Primary Examiner*—Alexander Grosz

*Attorney, Agent, or Firm*—Chernoff, Vilhauer, McClung & Stenzel

[57] ABSTRACT

A cushioning device, which can be a mattress, mattress pad or seat for supporting a person by distributing force over a support area of the person's body, comprises a gel-filled flexible enclosure with variably-adjustable supportive force distribution to prevent pressure points and resultant decubitus ulcers (bed sores) in patients and others who must spend long periods of time in prone or seated positions. The flexible enclosure has flexible barriers which divide the enclosure into multiple gel-containing compartments each underlying a different portion of the supportive surface of the device and preventing the transfer of gel from one compartment to another. Selectively openable and closable ports each communicate between the interior of a respective compartment and the exterior of the enclosure for enabling the infusion or extraction of gel from a particular compartment so as to variably adjust the distribution of supportive force. One or more gel containers, separate from the flexible enclosure, matingly couple with the respective ports for delivering gel to or receiving gel from the respective compartments.

3 Claims, 2 Drawing Sheets

GEL-FILLED, VARIABLY-ADJUSTABLE CUSHIONING SYSTEM FOR SUPPORTING A PERSON

BACKGROUND OF THE INVENTION

This invention relates to cushioning pads, mattresses, and seats for supporting patients and others who must spend long periods in prone or seated positions. More particularly, the invention relates to a system for variably adjusting the distribution of supporting force imposed over a support area of a person's body by a gel-filled cushioning device so as to reduce the incidence of decubitus ulcers (bed sores).

A substantial number of mattresses and mattress pads have been developed in the past having as their objective the reduction of the incidence of decubitus ulcers in patients and others who must spend long periods in bed. These prior devices comprise flexible enclosures containing various cushioning materials such as air, liquid, gel, foam or granular materials as disclosed, for example, in U.S. Pat. Nos. 4,163,297, 4,454,615 and 4,628,557. Cushioning devices of the type shown in U.S. Pat. Nos. 4,163,297 and 4,628,557 further include a plurality of small pillow-like elements or inserts to permit the support surface configuration to be varied by the addition or removal of the pillow elements or inserts as the case may be, thereby enabling some adjustability of the distribution of the supportive force over the person's body. However, only adjustability in relatively large increments is provided by the addition or subtraction of such pillow elements or inserts, providing only a gross approximation of the optimum distribution of supporting force required by any particular patient depending on his individual weight, body shape, and posture required by his particular medical condition.

In an attempt to meet the need for a finer, more infinite variability in the adjustment of cushioning devices for patients, mattresses have been proposed having separate internal cells which are selectively inflatable and deflatable by connection with a set of patient-operated or automatically-operated valves which alternatively supply pressurized air to, or exhaust air from, the individual cells. While such a system provides infinitely-adjustable variability, as opposed to variability by gross increments, valving and controls therefor make the system expensive. More important, such a system of inflation and deflation is practical only if employed with an air-filled mattress where the individual compartments can thus be easily filled from, and exhausted into, the surrounding air. Unfortunately, air-filled mattresses do not produce the lowest skin-surface pressures. Rather, the lowest skin-surface pressures are obtained using a gel as the cushioning material, as taught, for example, by Berjian, et al., "Skin Pressure Measurements On Various Mattress Surfaces In Cancer Patients," 62 *American Journal of Physical Medicine* 217 (1983).

Accordingly, what is needed is a gel-containing cushioning device having separate compartments selectively capable of receiving or exhausting gel in infinitely variable increments to obtain infinitely variable adjustability of the distribution of supporting force on a person's body, together with an inexpensive external system for selectively receiving or delivering the gel as needed.

SUMMARY OF THE PRESENT INVENTION

The present invention satisfies the foregoing need by providing a cushioning device, such as a mattress, mattress pad, seat cushion, or the like, in the form of a flexible enclosure having multiple, flexible, gel-containing compartments structurally interconnected with one another for containing a flowable gel, each underlying a different portion of a major supporting surface for supporting a person's body. A plurality of selectively openable and closable ports, each communicating between the interior of a respective compartment and the exterior thereof, enable the flow of gel into and out of the respective compartments. An exterior gel container, separate from the compartments, has an aperture for matingly and sealingly coupling with the ports so that it can selectively deliver gel to or receive gel from each of the compartments to variably adjust the distribution of supportive force exerted by the major supporting surface against the user's body. In this way the exterior gel container becomes a highly portable and easily handled accessory to the cushioning device, serving as a convenient reservoir into which excess gel may be exhausted from a particular compartment underlying a portion of the supporting surface where pressure is to be reduced, or as a reservoir from which additional gel may be injected into a compartment underlying a portion of the supporting surface where pressure is to be increased to compensate for decreased pressure elsewhere. The gel container also includes means for forcing the gel to flow into the respective compartments, which could conceivably be a pump but, for greater economy, preferably constitutes merely a variable-volume feature of the gel container itself. Preferably, flexibly movable containment walls may be folded or rolled to decrease the volume of the gel container and thereby force the flowable gel into a respective compartment.

The ports by which gel is injected into or exhausted from each compartment preferably include one-way checkvalves which permit the gel to flow into the compartment but prevent its exhaust therefrom unless mechanically opened by engagement with a valve-opening member associated with the gel container. Thus spillage of the flowable gel, in the process of injecting or exhausting it through the ports, is prevented.

It is therefore a principal objective of the invention to provide an inexpensive cushioning device which enables gel-containing flexible compartments to be employed compatibly with an infinitely-variable system for adjusting the distribution of supporting force provided by the cushioning device against the body of the user.

It is a further objective of the invention to provide a corresponding method for providing such gel-containing cushioning consistent with such infinitely variable adjustability of force distribution.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figures 1, 2:
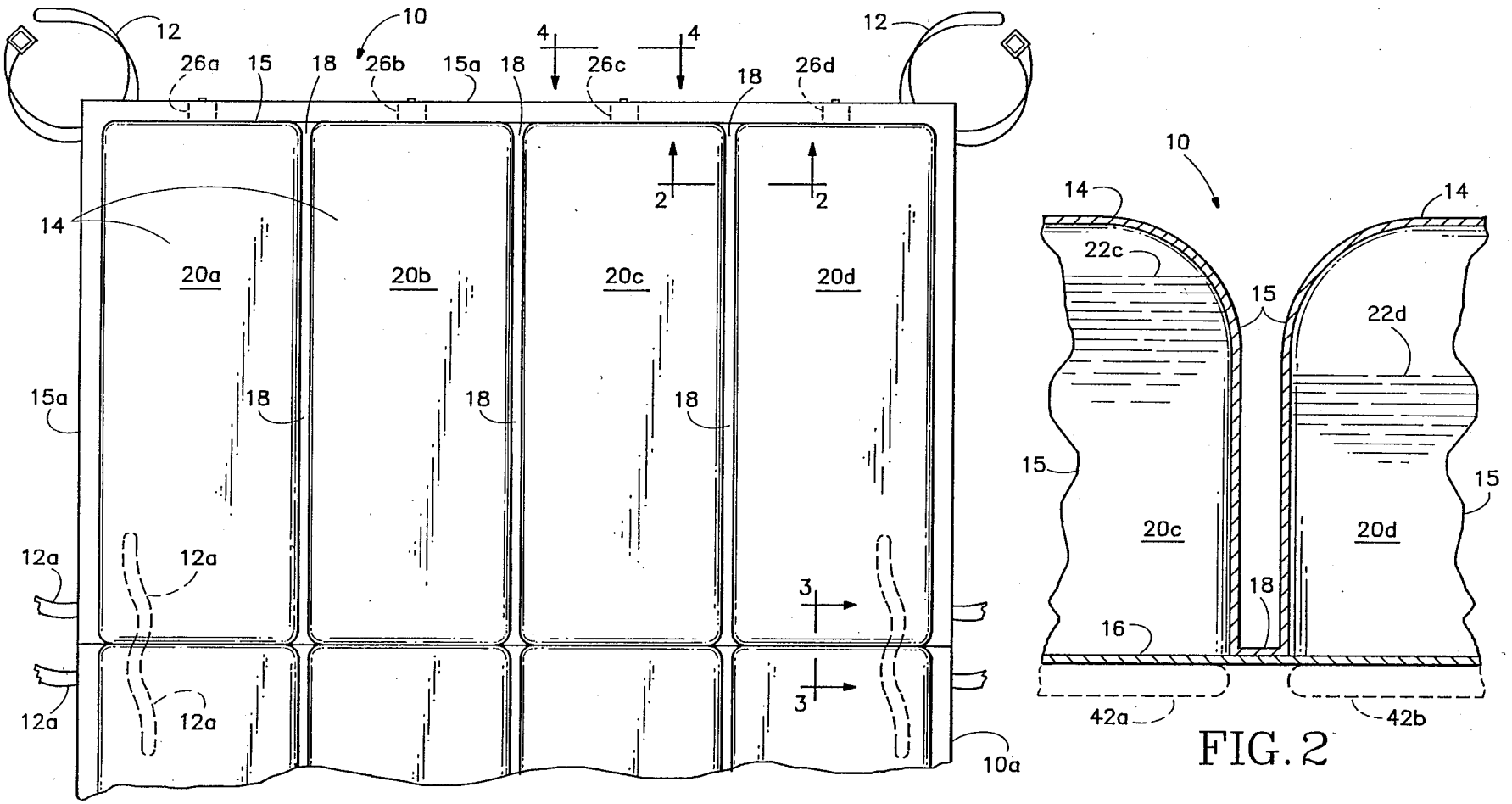
FIG. 1 is a top view of an exemplary embodiment of a mattress pad constructed in accordance with the present invention, with such pad joined at one edge to a second pad shown partially.
FIG. 2 is an enlarged sectional view taken along line 2—2 of FIG. 1 showing a junction separating respective gel-containing compartments.

With reference to FIG. 1, an exemplary mattress pad indicated generally as 10 comprises a series of flexible compartments 20*a*, 20*b*, 20*c* and 20*d* encapsulating a gel. The mattress pad may be of single-bed width and length for use alone on a single bed or, in conjunction with a second mating gel-filled mattress pad 10*a* of similar construction, for use on a king-size bed. Alternatively, the pad 10 could be of one-half double bed width or one-half queen bed width and equal to full bed length. Straps such as 12 secure the corners of the pad around the bottoms of the underlying corners of a conventional mattress, the straps such as 12*a* at the juncture of the two pads simply lying loose if not needed.

Figure 3:
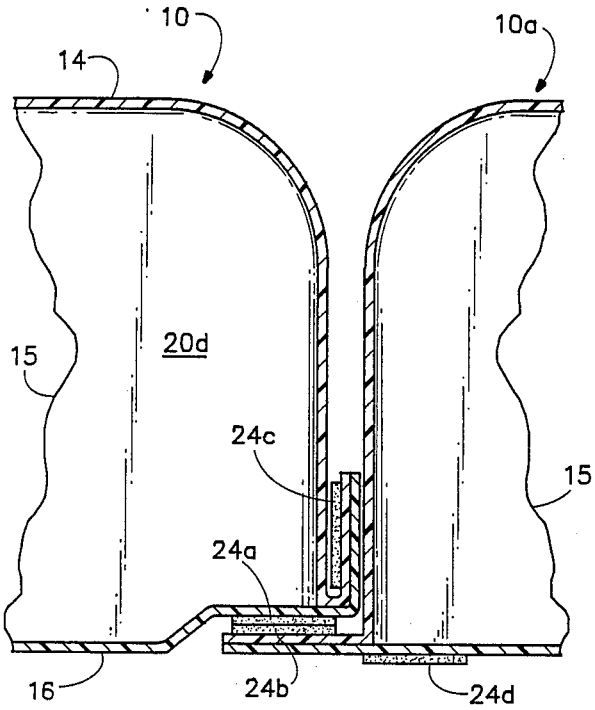
FIG. 3 is an enlarged sectional view taken along line 3—3 of FIG. 1, showing the joinder of the pair of pads.
Figure 4:
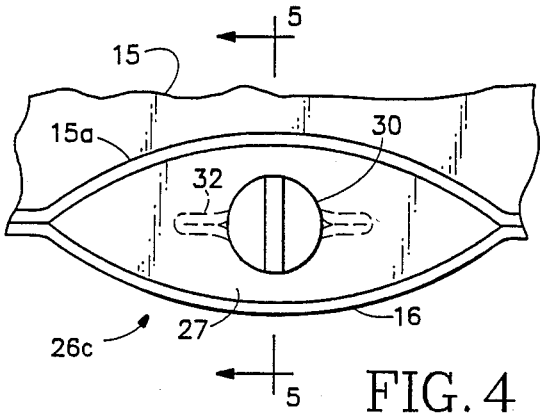
FIG. 4 is an enlarged view taken along line 4—4 of FIG. 1, showing a front view of an exemplary port by which a flowable gel may be injected into, or extracted from, a compartment of the pad.
Figure 5:
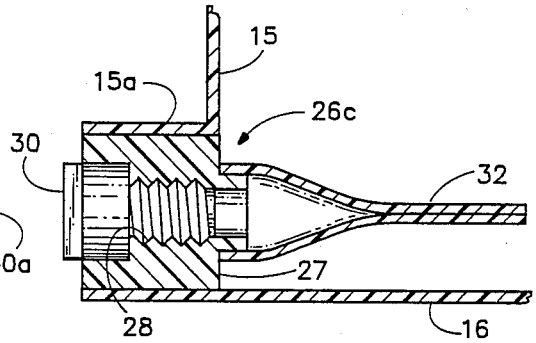
FIG. 5 is a sectional view of the port taken along line 5—5 of FIG. 4.

The top flexible panel 14 of the pad 10, composed of the flexible tops of the compartments 20*a*, 20*b*, 20*c* and 20*d* together with the flexible compartment sidewalls 15, is preferably constructed of light, heat-formed vinyl approximately 0.02 inches thick coated on its exterior with a fabric or foam rubber, although other fluid-impervious flexible materials can also be used. The top panel 14 comprises the major supporting surface for distributing force over a support area of the user's body. A bottom panel 16 of the same or similar material, but somewhat thicker (e.g. 0.025 inches thick), is glued or welded to margins 15*a* at the bottoms of the sidewalls 15 in a fluid-impervious manner. Separating the compartments 20*a*, 20*b*, 20*c* and 20*d* are a series of interior compartment sidewalls 15 welded or glued in a fluid-impervious manner to the bottom panel 16 along junctions 18 (FIGS. 1 and 2). Thus, each of the compartments 20*a*, 20*b*, 20*c* and 20*d*, respectively, underlies a different portion of the major flexible surface 14 of the pad 10 and is isolated by the interior sidewalls 15 from any other compartment. This prevents the transfer of gel portions, such as 22*c* and 22*d*, respectively (FIG. 2), from one compartment to another. With reference to FIGS. 1 and 3, pads such as 10 and 10*a* may be joined together by mating hook and loop type fasteners, such as the ones sold under the trademark Velcro, strips 24*a*, 24*b* affixed to the respective pads, or by any other suitable means. Additional mating hook and loop type fasteners, such as the ones sold under the trademark Velcro, strips 24*c* and 24*d* may optionally be provided so that all pads such as 10 and 10*a* may be of identical construction and yet always be capable of joinder. Each compartment has a respective selectively openable and closable port 26*a*, 26*b*, 26*c* or 26*d* mounted therein through which the gel can be selectively injected into or extracted from the respective compartments separately. To enable the effective use of the ports, the gel employed is a stable, flowable gel of any suitable known type, such as a mixture of methyl cellulose, water, preservative, coloring and bittering agent or, alternatively, a silicone gel. With reference to FIG. 5, each port preferably comprises a body 27 glued between the sidewall margin 15*a* and the bottom panel 16, although mounting of the ports in the sidewalls or bottom panel themselves is permissible. Each port body 27 has a threaded aperture 28 therein into which a sealing plug 30 may be screwed when the port is not in use. On the inside of the port body 27, a one-way checkvalve in the form of a flattened soft vinyl or rubber tube 32 is attached, such tube normally assuming the collapsed condition shown in FIGS. 4 and 5 which prevents gel from escaping through the port from inside the compartment when the plug 30 is removed.

Figure 7:
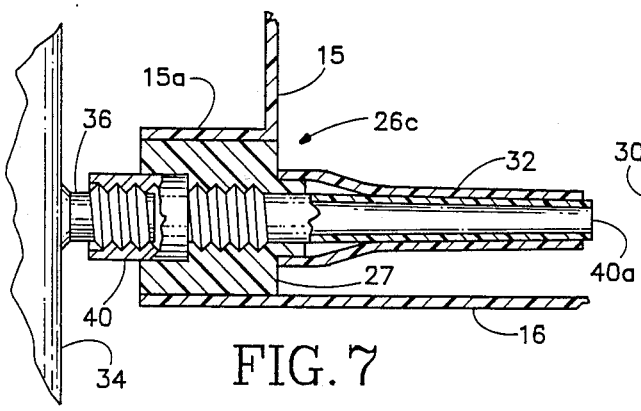
FIG. 7 is a sectional view of the port of FIG. 4 showing its operative coupling with the exterior gel container of FIG. 6.
Figure 6:
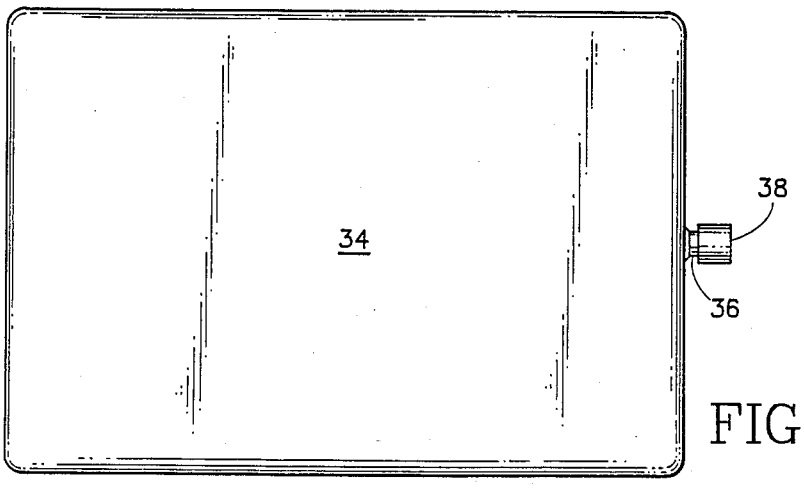
FIG. 6 is a top view of an exemplary exterior gel container usable in conjunction with the mattress pad of FIG. 1.

FIG. 6 shows an exemplary flexible vinyl gel container bottle 34 having a threaded spout 36 sealed by a threaded cap 38. With reference to FIG. 7, when the cap 38 is removed preparatory to use of the gel container 34, the cap may be replaced by an internally and externally-threaded nozzle 40 which screws onto the spout 36 and is in turn screwed into the port body 27 after the plug 30 has been removed. The nozzle 40 has sufficient length that its end 40*a* forces the sides of the normally collapsed tube 32 apart so as to permit the flow of gel through the port. Thus, if it is desired to extract gel from a particular compartment to lessen the supportive force applied to the user's body by the portion of the flexible supporting surface 14 overlying the compartment, pressure is applied externally to the top of the compartment thereby forcing gel from the compartment through the nozzle 40 into the external gel container 34. When sufficient gel has been extracted from the compartment, the nozzle 40 is unscrewed from the port body 27 and, as it is withdrawn, the checkvalve tube 32 automatically recloses to prevent any spillage. Thereafter the plug 30 may be reinserted in the port. Alternatively, if it is desired to add gel to the compartment to increase its share of the supportive force, the gel container 34 is connected to the port as shown in FIG. 7 and its volume gradually decreased by squeezing, folding or rolling its flexible containment walls so as to force gel through the nozzle 40 into the compartment. After the desired amount of gel has been added, the nozzle is withdrawn in the manner previously described and the plug 30 reinserted in the port.

In the foregoing manner gel may be transferred from one compartment to another, but only in a controlled, external manner rather than in an uncontrolled, internal manner, and without necessarily preserving a constant mass of gel within the pad 10. In this way the distribution of supporting force against the user's body may be adjusted in an infinitely variable, controlled manner to suit each user's individual needs.

It is also within the scope of the invention to equip the pad 10 with an electrically heated subpad, or with a cooled subpad, for heating or cooling the entire unit. Alternatively, if separate heating or cooling subpads such as 42*a*, 42*b* (FIG. 2) or other separate internal or external heaters or coolers are provided for the separate compartments, heating or cooling of selected compartments individually for the treatment of localized arthritic conditions or injuries is possible.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A cushioning device for supporting a person's weight by distributing force over a support area of the person's body in a variably-adjustable manner to prevent pressure concentration points in predetermined portions of said support area, said cushioning device comprising:

(a) a flexible enclosure assembly for containing a flowable gel, said enclosure assembly having a major flexible surface for distributing supportive force over a support area of a person's body; compartments, each underlying a different portion of said major flexible surface, and preventing the transfer of said gel within said enclosure from one of said compartments to another;

(b) means defining a plurality of selectively openable and closable ports, each communicating between the interior of a respective one of said compartments and the exterior of said enclosure, for enabling the flow of said gel into and out of the respective interiors of said compartments; and (c) gel container means, having means defining an aperture for mating and sealingly coupling with said ports, for selectively delivering said gel to or receiving said gel from the respective interiors of said compartments so as to variably adjust the distribution of said supportive force, said gel container means including means for forcing said gel to flow through said aperture and ports into the respective interiors of said compartments wherein each of said ports includes one-way check valve means for normally permitting said gel to flow through the respective port into the interior of a respective compartment while normally preventing said gel to flow through the respective port out of the interior of the respective compartment, and means associated with said aperture of said gel container means for selectively engaging and opening said one-way check valve means so as to permit said gel to flow through the respective port out of the interior of the respective compartment.

2. The apparatus of claim 1 wherein said gel container means is of a variable volume type having movable containment walls for selectively decreasing or expanding its gel-containing volume.

3. The apparatus of claim 2 wherein said gel container means has flexibly movable containment walls.

* * * * *

UNITED STATES PATENT AND TRADEMARK OFFICE

CERTIFICATE OF CORRECTION

PATENT NO. : 4,788,730

DATED : December 6, 1988

INVENTOR(S) : Robert A. Bexton

It is certified that error appears in the above-identified patent and that said Letters Patent is hereby corrected as shown below:

Col. 5, line 17 delete ";" and substitute therefor --and means for defining multiple--.

Col. 6, line 2 change "mating" to --matingly--.

Signed and Sealed this

Twenty-seventh Day of March, 1990

*Attest:*

JEFFREY M. SAMUELS

*Attesting Officer*

*Acting Commissioner of Patents and Trademarks*